United States Patent [19]

Jones et al.

[11] 4,307,849

[45] * Dec. 29, 1981

[54] APPARATUS FOR COLLECTING STRAND

[75] Inventors: Bernard H. Jones; Daniel Cox; Don R. Gallagher, all of Anderson, S.C.

[73] Assignee: Owens-Corning Fiberglas Corporation, Toledo, Ohio

[ * ] Notice: The portion of the term of this patent subsequent to Jun. 17, 1997, has been disclaimed.

[21] Appl. No.: 131,347

[22] Filed: Mar. 19, 1980

Related U.S. Application Data

[63] Continuation of Ser. No. 671,194, Mar. 29, 1976, Pat. No. 4,208,016.

[51] Int. Cl.[3] ..... B65H 54/02; B65H 67/04; B65H 75/28

[52] U.S. Cl. ..... 242/18 G; 242/18 A; 242/18 PW; 242/125.1

[58] Field of Search ..... 242/18 G, 18 A, 18 PW, 242/125.1, 46.5

[56] References Cited

U.S. PATENT DOCUMENTS

| | | | |
|---|---|---|---|
| 2,296,339 | 9/1942 | Daniels | 242/18 A X |
| 2,772,054 | 11/1956 | Herele et al. | 242/18 A |
| 3,099,411 | 7/1963 | Geen | 242/46.5 |
| 3,160,356 | 12/1964 | Fisher et al. | 242/18 PW |
| 3,198,445 | 8/1965 | Hull, Jr. et al. | 242/18 PW |
| 3,490,707 | 1/1970 | Warshaw et al. | 242/46.5 |
| 3,809,326 | 5/1974 | Wust | 242/18 A X |
| 3,813,050 | 5/1974 | Landwehrkamp | 242/18 A |
| 3,856,222 | 12/1974 | Wust | 242/18 A |
| 3,967,795 | 7/1976 | Shindo et al. | 242/125.1 |
| 3,986,680 | 10/1976 | Cardell | 242/125.1 |
| 4,069,984 | 1/1978 | Klink et al. | 242/18 G |
| 4,208,016 | 6/1980 | Jones et al. | 242/18 G |

FOREIGN PATENT DOCUMENTS

| | | | |
|---|---|---|---|
| 1104156 | 2/1968 | United Kingdom | 242/18 A |
| 1341034 | 12/1973 | United Kingdom | 242/18 PW |

*Primary Examiner*—Stanley N. Gilreath

*Attorney, Agent, or Firm*—Ronald C. Hudgens; Kenneth H. Wetmore

[57] ABSTRACT

The present invention embraces a winder method and apparatus for collecting linear material such as glass strand into a wound package. The winder has a rotatable collet of a first material and a second material positioned on the collet. The second material has a coefficient of friction sufficient to engage the strand and to bring the strand into fixed engagement with the collet upon the rotation of the collet.

4 Claims, 8 Drawing Figures

APPARATUS FOR COLLECTING STRAND

This is a continuation of application Ser. No. 671,194, filed Mar. 29, 1976, now U.S. Pat. No. 4,208,016.

BACKGROUND OF THE INVENTION

In many fiber forming operations such as forming continuous filament glass, winding apparatus collects filament bundles or strands as wound packages. The packages are wound on collecting tubes carried on a collet or spindle driven at high rotational speeds.

It has been conventional in the formation of glass strands to wind the strands upon a rotating sleeve at a desired speed to attenuate the filaments of the strand. When the package of wound strand is completed, the attenuation and winding operation is interrupted by the operator. The operator de-energizes the motor rotating the collecting sleeve to bring the sleeve to a stop. He then brakes the strand manually and removes the strand package from the winding collet. In this manual operation it is often difficult to begin winding a new package after one has been completed. It takes a skilled operator to manually begin the winding of the strand on the collet. The strand can slip and not begin collection if it is not precisely and skillfully placed on the collet by the operator. Improved apparatus is needed for easier strand collection start-up in this manual operation.

There are other winding systems used to collect filaments into wound packages. Some of these systems are more automatic than that just described. Some of these systems require precision speed relationships between collets for strand transfer when beginning a new package. With these more automatic systems there are problems with the collection of strand at start up. The strand can often slip or slide on the collet and thus a satisfactory start up or strand transfer may not occur.

Therefore, it can be seen that there is a need for an improved reliable mechanical system for beginning strand collection in winding operations.

SUMMARY OF THE INVENTION

The present invention embraces a winder for the collection of strand into a wound package. The winder has a rotatable collet of a first material and a second material positioned on the collet. The second material has a coefficient of friction sufficient to engage the strand and to bring the strand into fixed engagement with the collet upon the rotation of the collet.

The present invention also embraces a method of collecting strand into a wound package with a winding having a rotatable collet of a first material. The method including the steps of positioning a second material on the collet, engaging the strand with the second material and bringing the strand into fixed engagement with the collet upon the rotation of the collet.

An object of the invention is to provide an improved method and apparatus for package start-up when winding strand into wound packages.

Another object of the invention is to provide an improved winder which is less sensitive to collet speed for strand transfer to the collet for collection thereon.

Another object of the invention is to provide an improved method and apparatus for transferring strand from one collet to a second collet during the winding operation.

Other objects and advantages will become apparent as the invention is described more clearly hereafter in detail with reference being made to the accompanying drawings.

These drawings are generally illustrative of the method and apparatus for carrying out the invention but are not to be considered as limiting the invention to the specifics thereof.

DESCRIPTION OF THE PREFERRED EMBODIMENTS

Figure 1:
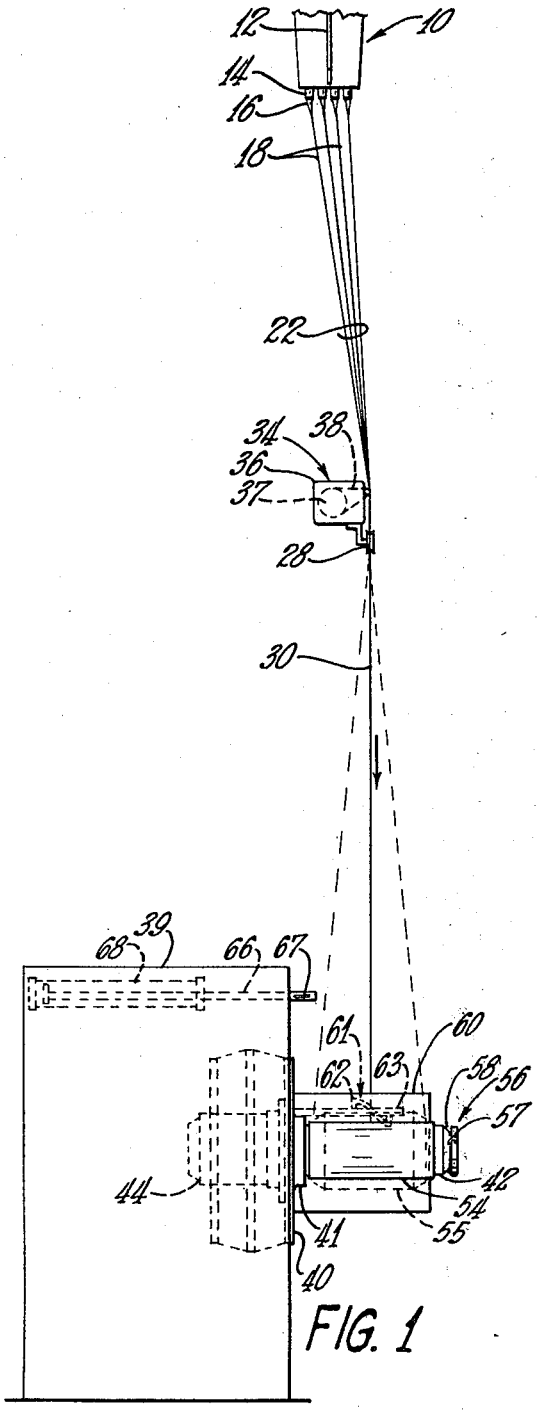
FIG. 1 is a side elevation view illustrating a form of automatic winder apparatus embodying the invention.
Figure 2:
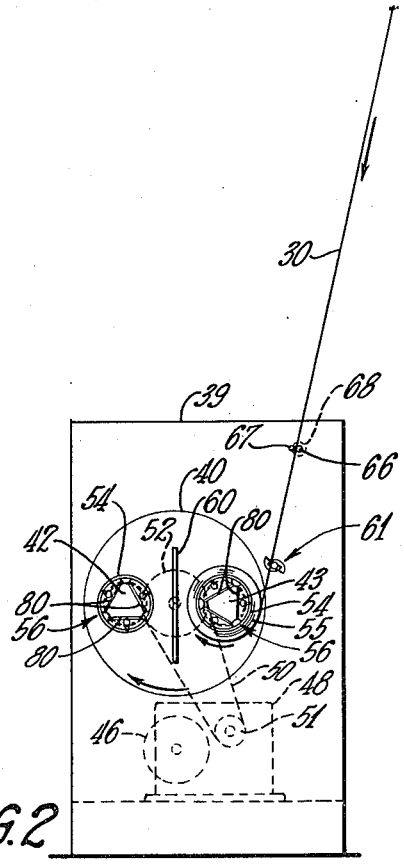
FIG. 2 is a front elevation view of the winding apparatus illustrated in FIG. 1.
Figure 3:
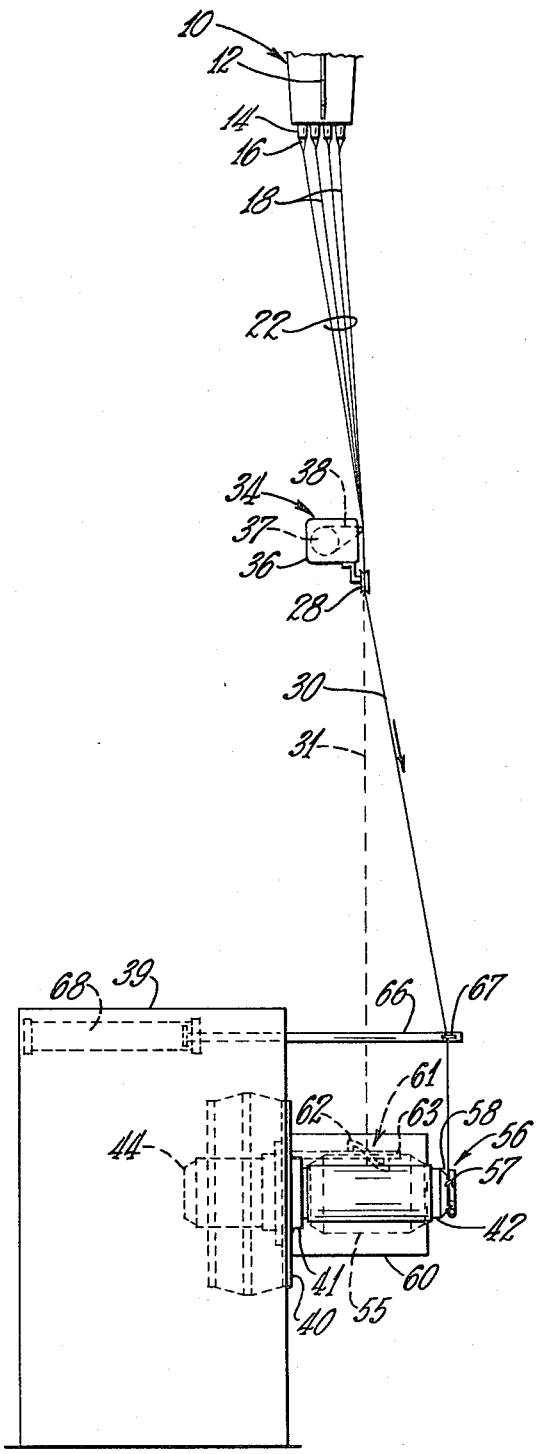
FIG. 3 is another side elevation view of the winding apparatus illustrated in FIG. 1.

Referring to the drawings in detail and initially to FIGS. 1, 2 and 3 there is illustrated a conventional type of stream feeder or bushing 10 containing a supply of heat softened filament forming material. The heat-softened material can be a mineral material such as glass. The feeder 10 has a floor provided with a comparatively large number of orificed tips or projections 14 flowing streams of glass 16 which are attenuated to filaments 18 which are gathered into a group 22.

The feeder 10 is formed of any alloy of platinum and rhodium or other materials capable of withstanding the intense heat of molten glass.

The feeder is provided with terminals 12 connected with a source of electrical energy for heating the glass or other mineral or heat-softenable material. The energy input is controlled by conventional means (not shown) to maintain the material in the feeder at a proper viscosity to promote the formation of uniform streams 16.

The group of filaments 22 is converged by gathering shoe or member 28 to form a strand 30. The filaments of the group are coated with a lubricant size or other coating material by means of an applicator arrangement 34 of conventional construction shown in FIG. 1. The applicator includes a receptacle 36 in which is held a roll 37 immersed in the coating material and an endless belt 38 being driven by roll 36 acquiring a thin film of the size coating material which is transferred to the filaments by wiping contact of the filaments with the film of size or coating on the belt.

FIGS. 1, 2 and 3 illustrate the automatic winding and package forming apparatus which includes a housing 39 enclosing the actuating and control components for carrying out or performing the steps in the method of attenuating the filaments and automatically packaging the strands of filaments. U.S. Pat. No. 3,408,012 describes conventional control means for such a winder. Such patent is herein incorporated by reference.

The portion of indexible and rotatable turret or head 40 at the front of housing 39 is provided with two hollow boss portions 41 enclosing journal bearings on which are journally supported winding collets 42 and 43. Head 40 is journally supported by means contained within the housing. Each of the collets 42 and 43 is individually driven by motor 44, one of which is illustrated in FIG. 1. Motors 44 are carried by the head or turret 40. The head or turret is indexible to two positions. Collet 43, in FIG. 2, is shown in package winding or forming position or location while collet 42 is in a diametrically opposed standby position.

Head 40 is adapted to be indexed in two positions in order to move the collet with a completed package away from the winding position and an empty collet into winding position for the formation of a new package. The head is rotated by motor 46 through gear reduction mechanism contained within housing 48 and through suitable drive means, such as belt 50 and sprockets 51 and 52. The energization of motor 46 is controlled by a suitable indexing means of conventional construction timed to index or rotate head 40 upon the formation of a completed strand package at the winding station.

Each of the collets 42 and 43 is adapted to accommodate strand collecting means such as tubular sleeve 54 on which a package is wound. Each of the motors 44 for rotating the winding collets and strand collectors or tubular sleeves carried thereby is of a type in which the speed may be varied for the purpose of progressively reducing the speed of rotation of the collet at the winding station as the strand packages increase in diameter during the winding operation.

The peripheral region of each of the collets 42 and 43 is formed with conventional longitudinally extending recesses in which are disposed bars or friction shoes (not shown) which are resiliently biased radially outwardly of the collets to frictionally grip the strand collectors or tubular sleeves to assure rotation of the same with the collets.

Disposed between winding collets 42 and 43 and fixedly mounted by head 40 is baffle means 60. This baffle means separates the package collection regions of the collets.

The winding apparatus includes strand traverse means 61 for distributing the strands lengthwise of the package and for oscillating the strand during traverse of the strand lengthwise of the package in order to effect crossing of individual convolutions or wraps of the strands as they are collected on the packages. In the embodiment illustrated, strand oscillator 62 is supported by reciprocal shaft 63 which extends into housing 39.

Journally supported upon carrier 63 is a strand oscillator or strand guide means 62 which is driven by a variable speed electrically energized motor for guiding and traversing the strand as it is collected upon the collet at the winding station. It is conventional to have a collector or tube placed upon the collet on which the strands are wound. As the strand travels at comparatively high linear speeds of upwards of 15,000 feet or more per minute, the strand oscillator is rotated at comparatively high speeds to effect high frequency oscillation of the strand and a crossing of individual convolutions or wraps of strand on the collet.

Collet 43 as shown can be described as having a package collection region and a temporary collection region. The collection region is the area where the strand is wound into package 55. The temporary collection region of the collet is shown as end cap assembly 56 in FIGS. 1, 2 and 3. The end cap assembly is shown to have guide surface or groove 58 running circumferentially around the end of the collet in the temporary collection region, elastomeric material 80 on a portion of the circumferential guide surface, and pins or members 57 projecting or extending out into the groove. This end cap assembly 56 will be more fully described later in regard to FIG. 7.

FIGS. 1 and 2 show the push off or knock off assembly in its retracted position. This knock off assembly includes rod 66 which is journally mounted in housing 39. The knock off mechanism may be activated by device 68 which is shown to be an air cylinder activating device. The knock off can, of course, be activated by other conventional means.

The knock off or push off is shown in its extended position in FIG. 3. As shown, L-shaped projection 67 extending outwardly and forward of rod 66 has contacted strand 30 and moved it to end region 56 of collet 42. The strand has thus been moved from its natural running line 31 where the strand is automatically moved because of tension during strand winding. The strand 30 runs generally vertically from projection 67 to the end cap or end region of the collet. The strand enters the circumferential guide surface or grooved portion 58 of the end region. Material 80 on or covering a portion of the groove engages the strand as it is guided to be engaged or captured by the member or pin 57. The end region 56 of the collet will be more fully described herein in regard to FIG. 7.

The push off or knock off mechanism serves a dual purpose. The knock off may be used to hold the strand from its natural running position 31 in the package collection region while it is being collected in the temporary collection region 56. Also, the knock off may be used to push the strand from its natural running position in the package collection region upon completion of a package thereon.

A simple push off rod 66 and L-shaped projection 67 has been described as the push off mechanism. This mechanism may be of other configurations as needed for the number and type of packages being built on the collet. FIGS. 1, 2 and 3 show a winder forming a single package on a collet. This is shown as an example. The embodiment herein described encompasses two or more packages being collected on a collet.

Other embodiments where this invention can be used are shown and described in U.S. patent application Ser. No. 590,736. This application is hereby incorporated by reference.

Figure 4:
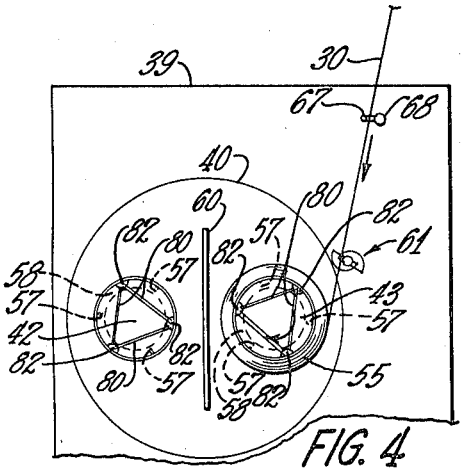
FIG. 4 is a schematic view illustrating the method step of collecting or winding linear materials to form a package, the package being shown as substantially complete.
Figure 5:
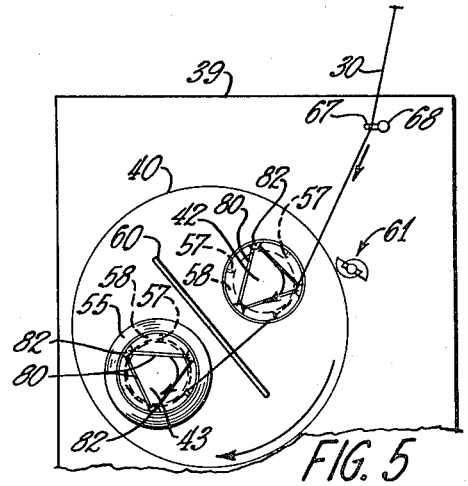
FIG. 5 is a view similar to FIG. 4 illustrating an indexing movement of the collet supporting head wherein the completed package is moved away from the winding station and an empty collet is moved toward the winding station.
Figure 6:
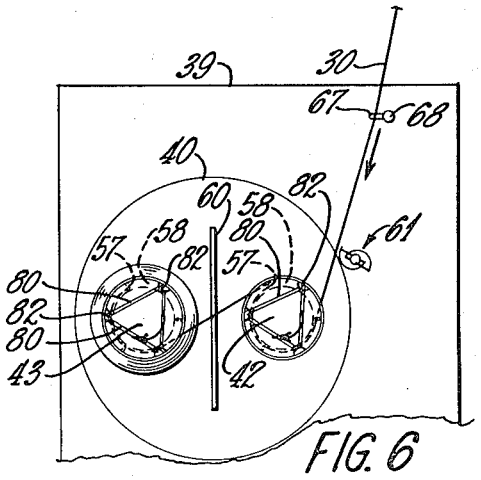
FIG. 6 is a view similar to FIG. 5 illustrating the transfer of the strand onto the empty collet.

FIGS. 4, 5 and 6 show the method of automatic transfer of the strand from one collet to another on a winder like that shown in FIGS. 1, 2 and 3.

As shown in FIG. 4 there are two collets 42 and 43 mounted on indexing head 40. Between the collets there is center plate 60. The center plate extends out separating the collets in their package collection region but terminates prior to the temporary collection region. Each collet in its temporary collection region or end cap section has a circumferential guide surface or groove 58, a material 80 on a portion of the guide surface and at least one fixed member 57 extending into the groove. Groove 58, material 80 and members 57 are shown in more detail and will be discussed with reference to FIGS. 7 and 8. In FIG. 4, collet 43 is shown in the winding location or winding position and a package is being completed.

FIG. 5 shows the knock off mechanism extended and having moved strand 30 laterally along the collet into the temporary collection region of collet 43. The linear material or strand advancing to the first collet is contacted by the second rotating collet 42 in its temporary collection region to engage the strand on material 80 on the guide surface and to engage the strand on member 57 to move the strand with it and thereby to begin collection of the material in the temporary collection region of second collet 42 and to sever the material between collets 42 and 43. The engagement by the strand on material 80 is more fully described later in reference to FIGS. 7 and 8. As shown, indexing head 40 moves the completed package on collet 43 from the winding location and the second rotating collet on the head into the winding location. The strand enters the circumferential guide surface or groove 58 and as it moves along the guide surface it contacts material 80 on the guide surface. The material is shown to be three groups of a plurality of bands of elastomeric material each have a portion which is generally located in the bottom of the groove. As the strand contacts groups of the bands of material 80, the strand is frictionally engaged by the material to substantially eliminate strand slippage as the strand wraps in the groove. Also, the strand can tangle with the plurality bands in a group for additional engagement between the strand and the bands to substantially eliminate strand slippage as the strand is wrapped in the groove.

FIG. 6 shows the indexing of head 40 completed. Collet 42 is now in the winding position. As shown, strand 30 has been engaged by material 80 in the groove and captured or engaged by pin 57 of second collet 42. The strand has been engaged by the groups of bands of material 80 by frictional engagement between the two and/or by entanglement between the two. The strand has been guided beneath the pin and upon rotation of the collet the strand has been bent over the member or pin to capture or engage the strand to move the strand with it and thereby begin collection of the strand in the temporary collection region of collet 42. Collet 42 is pulling or moving the strand between the collets in a clockwise direction as it is being collected in the temporary collection region of collet 42. Also, collet 43 is holding the strand stationary or moving the strand between the collets in a clockwise direction. Thus, it can be seen that the strand between the collets is being pulled in opposite directions and fractures causing severance of the strand between the collets. The finished package is then doffed from stationary collet 43.

Strand 30 is now being collected upon the temporary collection region of collet 42. The natural running line of the strand is toward the package collection region of the collet. When the push off mechanism is retracted the strand will automatically move laterally along the second collet from the temporary collection region to the collection region to begin package formation. However, the knock off or push arm can be kept in the extended position until the collet is brought up to a desired speed. When the desired collet speed is reached, the knock off is retracted and the strand moves along the collet to the package collection region.

Figure 7:
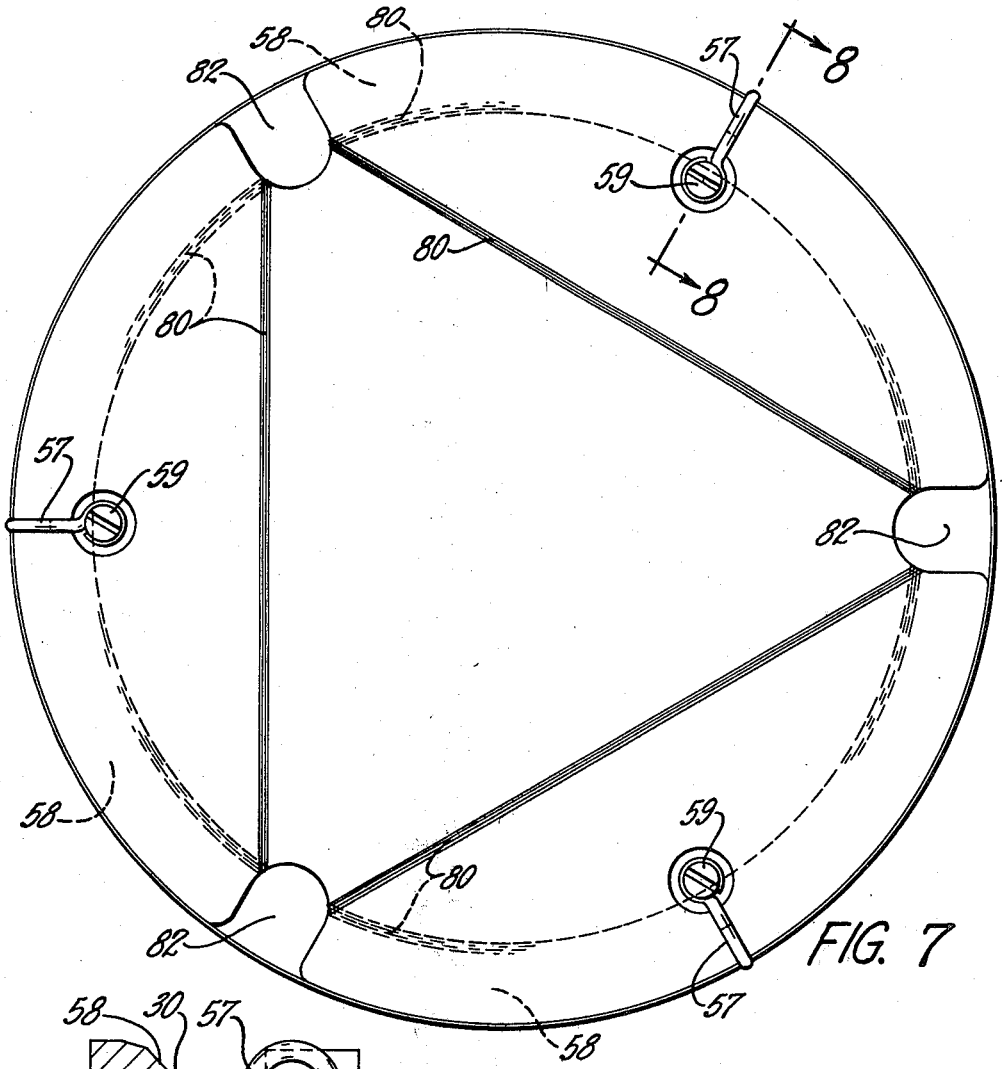
FIG. 7 is an enlarged front view of the end region of the collet shown in FIG. 1.

FIG. 7 is an enlarged front view of the end region of the collet. In this embodiment of the end region of the collet there are three fixed members or pins 57. One pin or a plurality of pins can be used. These curved fixed pins 57 are secured on the collet by screws 59. The curved pins, which are shown in more detail in FIG. 8, extend into groove 58. The end region of the collet generally has cleaning slots and three such slots 82 are shown as an example. After a package has been completed and is to be doffed (removed from the collet), any strand that has been wound in the guide surface or groove 80 of the temporary collection region is removed. This removal of strand from the groove is generally done by extending a knife into a cleaning slot and severing the strand that is wound therein. The strand can then be easily removed from the groove 58. This cleaning of the groove 58 is generally done after each package has been completed just before or just after the package is doffed.

Material 80 covers a portion of groove 58 for engaging strand. In the embodiment shown in FIG. 7, a portion of three groups of a plurality of bands of material 80 is positioned in groove 58. This embodiment is given as only an example of how material may be positioned in the groove. As shown in this embodiment a group of a plurality of strips or bands of material extends along and on a portion of groove 58, through a clean out slot, along and on a portion of the front end surface of the collet, and through another clean out slot. The strips or bands of material are continuous in a loop and are of a stretchable elastomeric material. The group of bands is layed in the groove and stretched over the clean out slots such that the bands attempt to contract to its unstretched length and are thereby held on the collet. An advantage to using such continuous loops of stretchable material is that the material can be removed from the collet when desired by stretching the material still further and lifting it out of the clean out slots. As an example a plurality of "rubber bands" of a size 16 or 18 having a rectangular cross section can be used for material 80. By having several groups of bands of material extending between the clean out slots as shown in FIG. 7 rather than one group of bands extending circumferentially around in the groove, the strands wound in the groove may be cut through the clean out slot and removed without damage to material 80.

These groups of a plurality of bands of stretchable elastomeric material are shown as an example. Many other embodiments can be used. For example, the groove or guide surface 58 can be partially or entirely coated with an elastomeric material. Such material is "contact cement" sold by Minnesota Mining And Manufacturing Corporation or other rubber cements can be used to coat or cover all or a portion of the groove or guide surface. The groove or guide surface is generally made of aluminum. Materials 80 which are used should have a coefficient of friction which is higher than such grooves or guide surfaces.

Groups of bands of material such as the three groups shown in FIG. 7 have found to be especially satisfactory. These groups of bands of stretchable elastomeric material have a high coefficient of friction so as to engage the strand being wound in groove 58 to substantially eliminate slippage by the strand in the groove. Also, by using groups of bands of material, the strand can become entangled with the bands to aid in substantially eliminating slippage of the strand as it is being wound in the groove.

It is important to prevent slipping of the strand as it is wound on the end cap. During the automatic transfer cycle as described in FIGS. 4, 5 and 6, as the second end cap comes into the strand line at a high speed, the pick up pins 57 must capture the strand, break the strand and start it winding on the end cap region of the second collet. If there is slippage of the strand as it begins winding in the guide surface or groove of the temporary collection region of the second collet, the speed of the strand can slow up as it slips and then jerk back to full speed as it catches on the pin. This jerking of the strand can cause problems in the fiber forming area such as an interruption in the forming of fibers.

Figure 8:
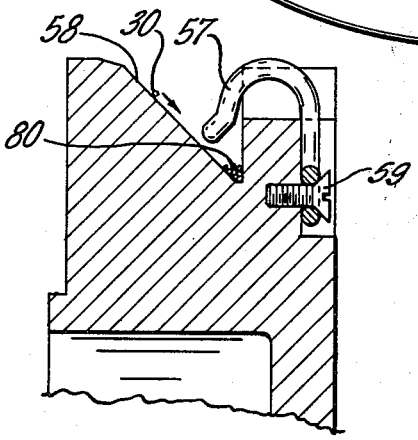
FIG. 8 is a partial sectional view of the end region of the collet shown in FIG. 7 and shows the continued movement of the strand shown in FIG. 7.

FIG. 8 shows a sectional view of a portion of the end cap shown in FIG. 7. Fixed pin 57 is shown extending into guide surface or groove 58 and is held securely by screw 59. A portion of a group of bands of elastomeric material 80 are shown on the bottom portion of groove 58. As the strand moves axially along the collet in groove 58, the strand contacts material 80. As the strand contacts the group of bands of material, the strand is frictionally engaged by the material. Also, in this embodiment where there is a group of a plurality of bands of material in the groove, the strand becomes entangled with the bands to aid in substantially eliminating strand slippage.

Having described the invention in detail, it will be understood that such specifications are given for the sake of explanation. And various modifications and substitutions other than those cited may be made without departing from the scope of the invention as defined in the following claims.

We claim:

1. A winder for making wound strand packages comprising:

a. a rotatable collet with a circumferential catch groove arranged at the end of the collet, the end region of the collet comprising at least one cleaning aperture opening axially outwardly and extending as far as the bottom of the groove; and b. a plurality of bands of material, the bands comprising closed loops which are expandably stretched over the end region of the collet such that a portion of the bands extends along at least a portion of the catch groove so that a strand entering the catch groove becomes entangled with the bands, the circumferential groove being free from the bands in the region of the cleaning aperture.

2. A winder for making wound strand packages comprising:

a. a rotatable collet with a circumferential catch groove arranged at the end of the collet, the end region of the collet comprising a plurality of cleaning apertures distributed over the circumference of the end region of the collet; and b. a plurality of bands of material, the bands comprising closed loops which are expandably stretched over the end region of the collet such that a portion of the bands extends along a portion of the circumferential catch groove and exits via adjacent cleaning apertures to form the loop so that a strand entering the catch groove becomes entangled with the bands.

3. A winder for the collection of a strand into a wound package comprising:

a. a driven rotatable collet with a circumferential engagement groove which is positioned in the end region of the collet and at least two cleaning openings distributed over the circumference of the end region of the collet;

b. a plurality of bands of material extending along the engagement groove over part of the circumference thereof to engage a strand inserted into the groove, the bands of material comprising closed rings tensioned over the end region of the collet such that a portion of each band extends along the engagement groove and extends out from and into the groove through adjacent cleaning openings so that the rest of each band is located outside the engagement groove.

4. The winder of claim 3 wherein the bands comprise an elastomeric material.

* * * * *